US005299440A

United States Patent [19]

Barraclough et al.

[11] Patent Number: 5,299,440

[45] Date of Patent: Apr. 5, 1994

[54] ROLLING MILLS

[76] Inventors: Keith S. Barraclough, Old Court Barn, West Mudford, Yeovil, Somerset BA21 5TJ; Ian Carey, The Dairy House, Charlton Horethorne, Sherborne, Dorset DT9 4NX, both of United Kingdom

[21] Appl. No.: 809,556

[22] PCT Filed: Jul. 25, 1990

[86] PCT No.: PCT/GB90/01148

§ 371 Date: Feb. 7, 1992

§ 102(e) Date: Feb. 7, 1992

[30] Foreign Application Priority Data

Aug. 9, 1989 [GB] United Kingdom ..... 8918228
Jan. 4, 1990 [GB] United Kingdom ..... 9000174

[51] Int. Cl.[5] ..... B21B 35/14; B21D 5/12

[52] U.S. Cl. ..... 72/181; 72/249

[58] Field of Search ..... 72/181, 179, 249, 238

[56] References Cited

U.S. PATENT DOCUMENTS

| | | | |
|---|---|---|---|
| 287,008 | 10/1883 | Daniels | 72/238 |
| 351,675 | 10/1886 | Weaver | 72/249 |
| 420,100 | 1/1890 | Reed | 72/238 |
| 1,021,628 | 3/1912 | Reeves | 72/249 |
| 1,227,604 | 5/1917 | Fraser | 72/181 |
| 1,336,177 | 4/1920 | Withers | 72/249 |
| 1,847,713 | 3/1932 | Gibbons | 72/249 |
| 4,724,695 | 2/1988 | Stoehr | 72/181 |
| 4,939,919 | 7/1990 | Chezzi | 72/249 |
| 4,977,769 | 12/1990 | Kruckels | 72/249 |

FOREIGN PATENT DOCUMENTS

| | | | |
|---|---|---|---|
| 505303 | 7/1930 | Fed. Rep. of Germany . | |
| 565148 | 11/1932 | Fed. Rep. of Germany . | |
| 717933 | 1/1932 | France . | |
| 1399907 | 7/1975 | United Kingdom | 72/181 |

*Primary Examiner*—Daniel C. Crane
*Attorney, Agent, or Firm*—Young & Thompson

[57] ABSTRACT

A rolling mill has a power source (10) driving a common drive shaft (11) which in turn drives gearboxes (12 to 15). Each gearbox drives a respective shaft (16–19) which in turn drives a roll (20 to 23). A free wheel (24) is provided between the gearbox and forming surface of its associated roll.

6 Claims, 1 Drawing Sheet

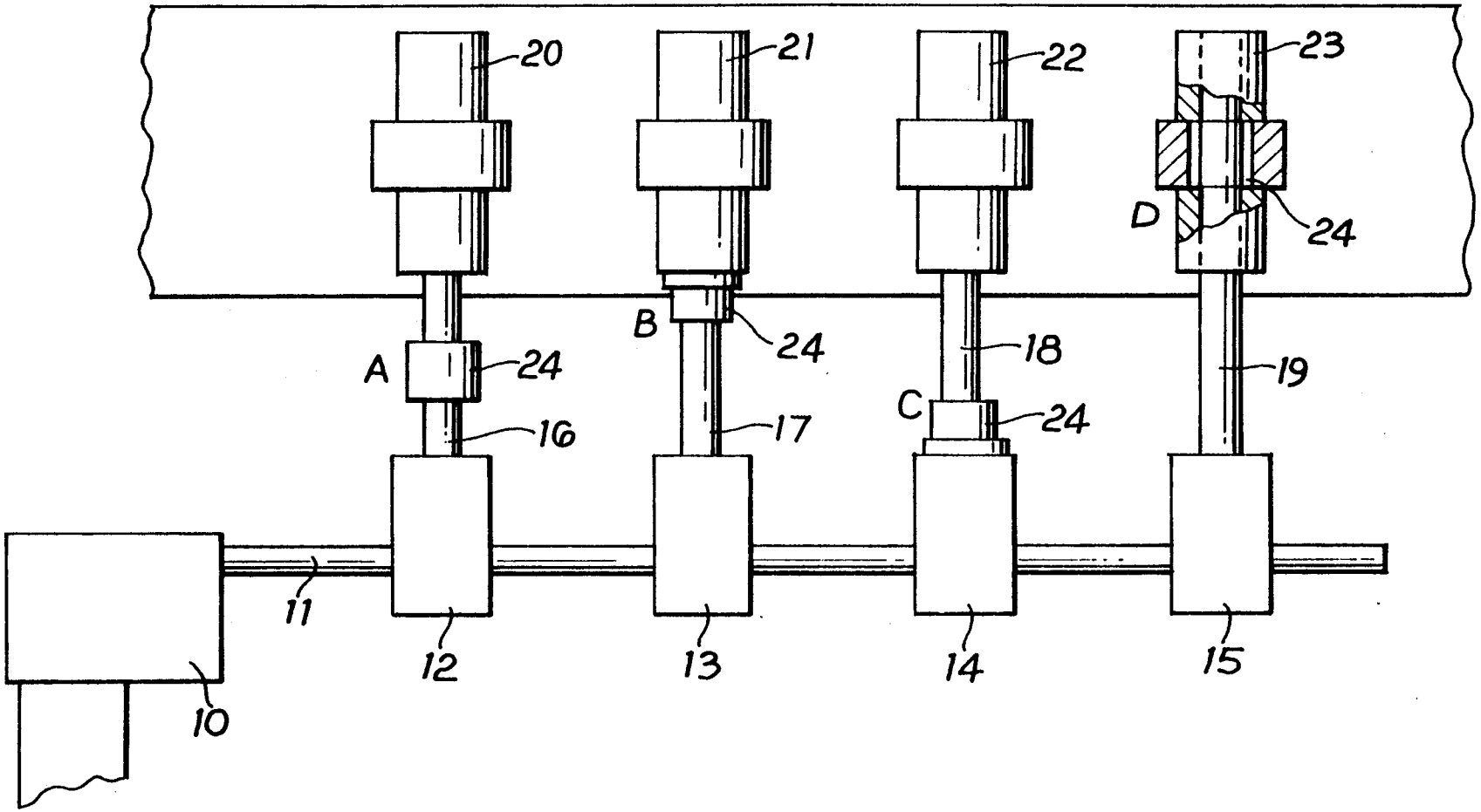
23
24
19
15
D
22
18
24
14
C
21
24
17
13
B
20
24
16
12
A
11
10

ROLLING MILLS

FIELD OF THE INVENTION

This invention relates to rolling mills and in particular, but not exclusively, to tube or profile rolling mills.

BACKGROUND OF THE INVENTION

Typically in tube and profile rolling mills there are a number of rolls and pairs of rolls spaced longitudinally along a forming path, the rolls being shaped to form a tube or profile from an initially flat strip, as the strip passes along the mill. Each roll has its own gearbox set to a carefully calculated ratio and is driven from that gearbox by a driven shaft. Although at manufacture, the gear ratios and roll dimensions are precisely defined, in practice these calculations are frequently invalidated by variations in material thickness and wear on the rolls. The result is that very often only one pair of rolls is travelling at the material speed and other rolls are either being pushed or pulled along by the material. This action not only causes further wear but also leads to a substantial recirculation of energy within the unit making it inefficient and expensive to run. To date no economic solution to this problem has been discovered and indeed in many mills the drive from a number of rolls is simply disconnected because of this problem.

The lack of an adequate solution is particularly surprising in view of the fact that on a typical tube forming mill the refurbishing of worn rolls costs many thousands of dollars per annum quite apart from the expensive down-time which occurs during the replacement of the rollers.

It is an object of the present invention to mitigate many of these difficulties.

SUMMARY OF THE INVENTION

The present invention consists in a roll-forming mill having a plurality of rolls longitudinally spaced along a forming path, means for driving the rolls and free wheel means between the forming surface of a roll and the drive means; the rolls being arranged in longitudinally adjacent co-operating pairs, and every pair which has an associated free wheel means, has a free wheel means for each roll in the pair.

Not all rolls in the mill need necessarily be provided with free wheels to obtain at least some of the advantage of the invention.

The rolls may be driven from a common shaft by respective gearboxes and the free wheel means is disposed between the forming surface of a roll and the common shaft.

Preferably all the rolls are provided with a free wheel means which may be disposed within the gearbox, at either end of its respective drive shaft or between its ends or, alternatively, within the hub of the roll itself.

The provision of free wheel means, such as a free wheel or uni-directional clutch in any roll drive allows the roll to free wheel as soon as the material tries to drive the roll faster than the drive shaft, thereby preventing the recirculation of energy and reducing wear. Where all the rolls are provided with free wheels, the free wheels will effectively act together to achieve an even distribution of load throughout the machine, not only reducing roll wear, but also wear on other transmission elements.

In addition to these advantages the system can easily be retrofitted to existing machines and achieves control without the introduction of expensive and unreliable electronic control feedback circuits or the like.

Although the invention has been defined above, it is to be understood that it includes any combination of the features set out above or in the following description.

BRIEF DESCRIPTION OF THE DRAWING

The invention may be performed in various ways and specific embodiments will now be described, by way of example, with reference to the accompanying drawing which illustrates part of a device system of a roll forming mill.

DESCRIPTION OF THE PREFERRED EMBODIMENT

Thus a power source 10 drives a common drive shaft 11 which in turn drives respective gearboxes 12 to 15. Each of these gearboxes 12 to 15 drives a respective shaft 16 to 19 which in turn drives a respective roll 20 to 23. In each transmission link between the gear and its respective roll there is provided a free wheel or unidirectional clutch 24. The position of the free wheel or clutch 24 is not critical and it can for example be located in any one of the positions marked A,B,C or D. Any appropriate free wheel or unidirectional clutch may be used and the type employed will depend on the power being transmitted and the roll speed for any particular roll.

Alternatively the single motor and common drive shaft, illustrated in FIG. 1 of the earlier Application, may be replaced by individual motors for each roll or pairs of rolls or associated groups of rolls. Additionally or alternatively the free wheels may be in the gearboxes associated with the rolls.

We claim:

1. A roll-forming mill form forming an initially flat strip into a tube or profile as the strip passes lengthwise in one direction along the mill, the mill having a plurality of pairs of opposed forming rolls spaced apart along said direction, drive means for rotating said rolls of a plurality of said pairs to advance a strip in said direction between the rolls of each said pair, and free wheel means between the forming surface of each roll of one said pair and said drive means of said one pair and free wheel means between another pair of rolls in said mill and said drive means, said free wheel means transmitting drive from said drive means to said forming surface when the rolls of said one pair rotate at a peripheral speed at least as great as the speed of movement of said strip in said direction but permitting said rolls of said one pair to free wheel relative to the other said pairs and relative to each other when said peripheral speed is less than said speed of said strip in said direction.

2. A roll-forming mill as claimed in claim 1, wherein all said roll pairs are provided with said free wheel means.

3. A roll-forming mill as claimed in claim 1, wherein each roll of said at least one roll pair has a drive shaft and said free wheel means is located at an end of each said drive shaft.

4. A roll-forming mill as claimed in claim 1, wherein each roll of said at least one roll pair has a drive shaft and said free wheel means is located intermediate the ends of said drive shaft.

5. A roll-forming mill as claimed in claim 1, wherein each roll of said at least one roll pair has a hub, and said free wheel means is located in the said hub.

6. A roll-forming mill as claimed in claim 1, wherein each roll of said at least one roll pair is driven by a gearbox and said free wheel means is in said gearbox.

* * * * *